US007878129B2

(12) United States Patent
Meyer

(10) Patent No.: US 7,878,129 B2
(45) Date of Patent: Feb. 1, 2011

(54) SWING-OUT WORKBENCH EXTENSION APPARATUS

(76) Inventor: Richard Meyer, 12715 Chandler Cir., Omaha, NE (US) 68138

( * ) Notice: Subject to any disclaimer, the term of this patent is extended or adjusted under 35 U.S.C. 154(b) by 394 days.

(21) Appl. No.: 12/002,141

(22) Filed: Dec. 14, 2007

(65) Prior Publication Data

US 2008/0308016 A1 Dec. 18, 2008

Related U.S. Application Data

(63) Continuation-in-part of application No. 11/122,041, filed on May 5, 2005, now abandoned.

(51) Int. Cl.
*A47B 11/00* (2006.01)

(52) U.S. Cl. ..... 108/138

(58) Field of Classification Search ..... 108/138, 108/145, 93, 71, 72, 76, 73, 143, 152, 69, 108/70, 77, 78; 248/919, 918, 920, 281.11; 254/10 C, 2 C, 3 C
See application file for complete search history.

(56) References Cited

U.S. PATENT DOCUMENTS 2,170,098 A * 8/1939 Stephenson ..... 108/136
2,545,515 A * 3/1951 Mast et al. ..... 108/138
2,630,359 A * 3/1953 Schade ..... 108/136
3,464,303 A * 9/1969 Mohr ..... 83/648
4,194,452 A * 3/1980 Crowther et al. ..... 108/138
4,625,657 A * 12/1986 Little et al. ..... 108/93
5,176,351 A * 1/1993 Moore ..... 108/138
5,549,052 A * 8/1996 Hoffman ..... 108/139
6,024,025 A * 2/2000 Koch et al. ..... 108/147
7,654,208 B2 * 2/2010 Patten ..... 108/138

* cited by examiner

*Primary Examiner*—José V Chen
(74) *Attorney, Agent, or Firm*—Stinson Morrison Hecker LLP

(57) ABSTRACT

A swing-out workbench extension for a workbench includes a rectangular swinging platform and four swinging upright members having equal lengths and each pivotably connected at the lower ends thereof to the rectangular platform, two on each side thereof. The four swinging upright members are pivotably mounted on the underside of a bench top of a workbench so that the rectangular swinging platform is movable between a stored position hanging below the bench top and an upper extended position generally adjacent a bench top. The rectangular platform extends at all times in a generally horizontal plane whereby tools mounted on the rectangular swinging platform are retained thereon, and a latch is provided for releasably locking the rectangular swinging platform in the upper extended position.

12 Claims, 10 Drawing Sheets

SWING-OUT WORKBENCH EXTENSION APPARATUS

CROSS-REFERENCE TO RELATED PATENTS

This continuation-in-part patent application claims priority based on a non-provisional patent application, specifically on patent application Ser. No. 11/122,041 filed May 5, 2005 now abandoned.

BACKGROUND OF THE INVENTION

1. Technical Field

The present invention relates to workbench accessories. More particularly, the present invention relates to a workbench extension for supporting tools which includes a rectangular swinging platform and four swinging upright members having equal lengths and each pivotably connected at the lower ends thereof to the rectangular platform, two on each side thereof. The four swinging upright members are pivotably mounted on the underside of a bench top of a workbench so that the rectangular swinging platform is movable between a stored position hanging below the bench top and an upper extended position generally adjacent a bench top. The rectangular platform extends at all times in a generally horizontal plane whereby tools mounted on the rectangular swinging platform are retained thereon, and a latch is provided for releasably locking the rectangular swinging platform in the upper extended position.

2. Description of the Prior Art

The use of workbench top space in limited areas for supporting such power tools as saws, is undesirable since workbench top space is at a premium for carrying out many tasks. It is known to provide a swing-away work surface addition. Known structures are complex and subject to failure and are not designed to carry heavy loads between a storage position and an extended position for use. It would be desirable to provide a workbench extension which is simple in design and sufficiently strong to support a power saw or other tool which can be moved to a storage position, out of the way of use of the workbench top, or moved into a position for use when need. Such a workbench extension could also be useful for additional work space when needed.

None of the above inventions and patents, taken either singly or in combination, is seen to describe the instant invention as claimed. Thus, a swinging shelf extension solving the aforementioned problems is desired.

SUMMARY OF THE INVENTION

The swing-out workbench extension of the present invention includes a rectangular swinging platform having a front member, a rear member, and opposed side members and forming four corners. Four lower axle supports are attached to and depend from the side members at the four corners thereof and include two lower forward axle supports and two lower rear axle supports. Four upper axle supports are attached to and depend from a workbench top vertically aligned with the four lower axle supports and including two upper forward axle supports and two upper rear axle supports. Four swinging uprights extend between respective upper and lower axle supports and include two front swinging uprights and two rear swinging uprights of such length that the rectangular swinging platform is swingable from a stored location below the bench top to an upper extended location substantially even in height with the bench top. Four front swinging axles rotatably connect the front swinging uprights with the respective front upper axle supports and front lower axle supports. Four rear swinging axles rotatably connect the rear swinging uprights with respective rear upper axle supports and rear lower axle supports.

The rectangular swing platform has at least one and preferably two tool support cross members extending between the respective opposed side members thereof. A latch is provided for releasably locking said rectangular swing platform in its said upper extended position. A heavy tool is connected to at least one cross member of the rectangular swing platform and is swingable outward from a stored position to an upper extended position and locked in place for use. The tool mounted on the rectangular swinging platform is also swingable downward to a stored position upon release of the latch.

These and other features of the present invention will become readily apparent upon further review of the following specification and drawings.

DESCRIPTION OF THE PREFERRED EMBODIMENT

Figure 1:
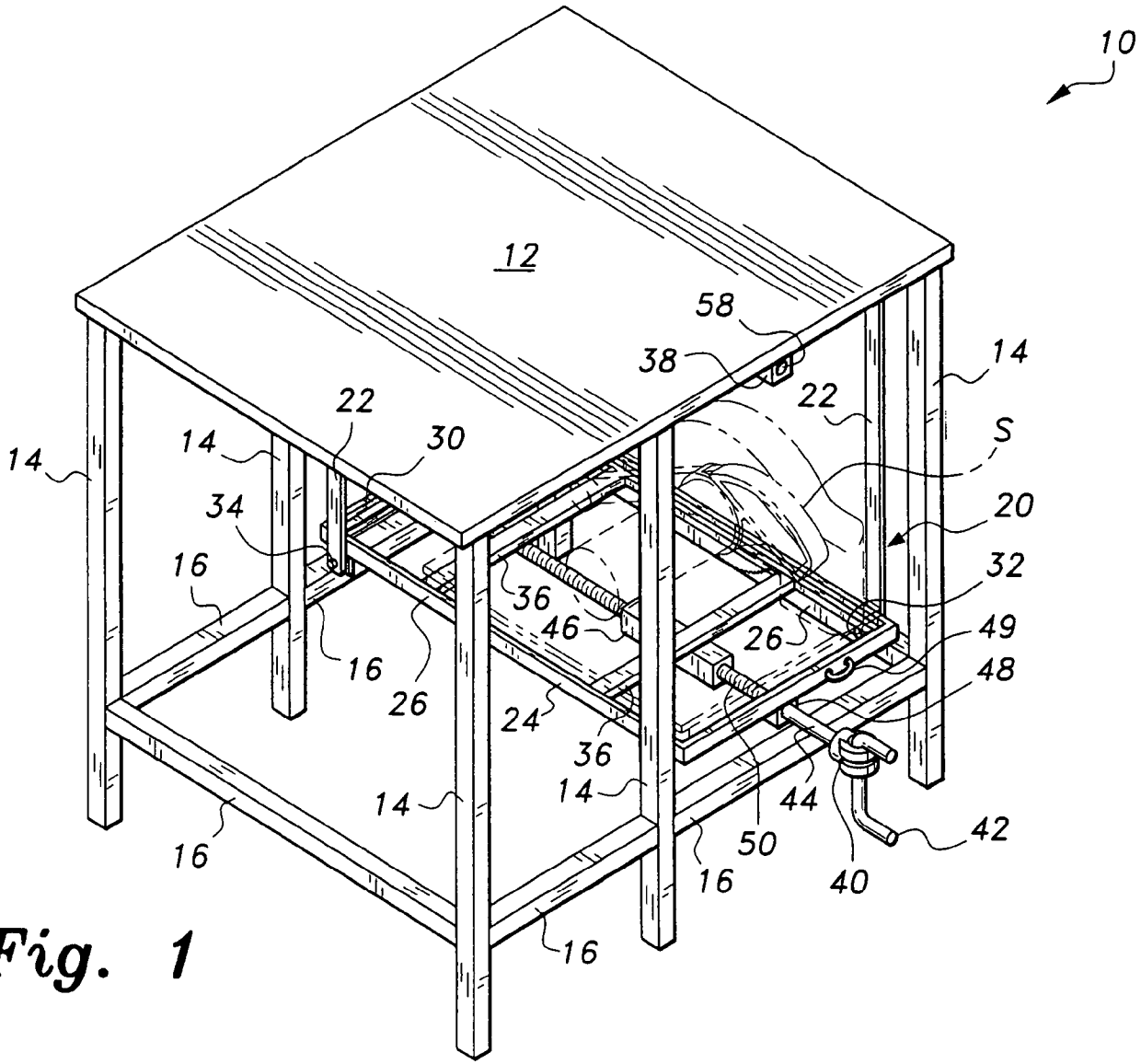
FIG. 1 is an environmental, perspective view of a swinging shelf extension in the stored position according to the present invention.

The present invention is a swing-out workbench extension for holding or mounting items such as power tools. The power tool on the extension swings out to a locking position and swings inward and downward underneath the workbench when not in use.

Referring to the Figures, swing-out workbench system 10 includes a workbench top 12 having legs 14 at least its corners and lateral leg supports 16. Swing-out shelf extension 20 includes swinging uprights 22 supporting a swinging platform portion 24 having side members 26, a front member 28, and a rear member, platform portion 24 being free to swing forward and upward on front swing axles 32 and rear swing axles 34 at respective upper and lower ends of the swinging uprights 22. Platform front, side, and rear member are conveniently made of angle steel stock welded or otherwise attached to form the rectangular swinging platform 24.

Figure 2:
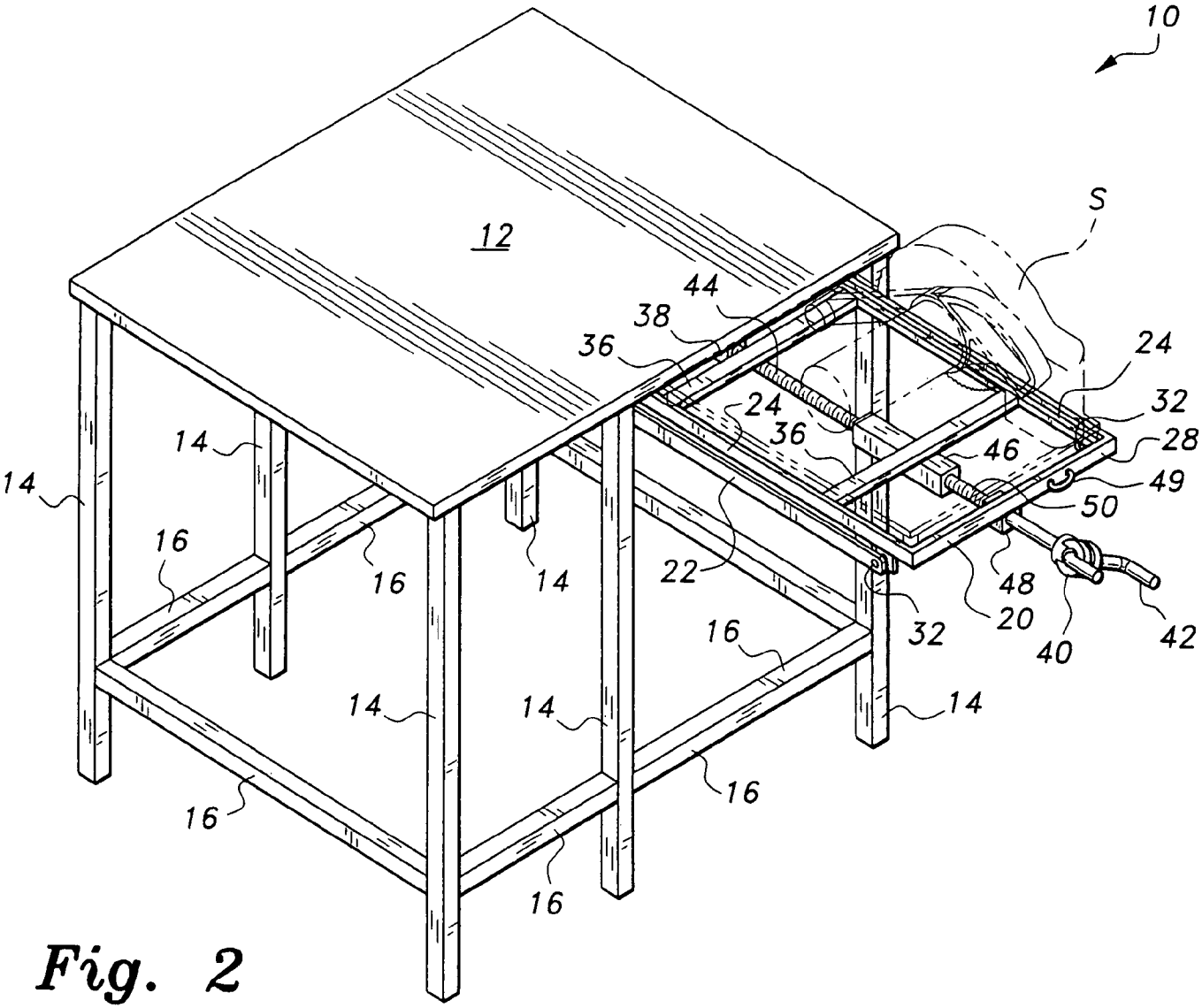
FIG. 2 is a view similar to that of FIG. 1 with the swing shelf extension swung to the upper extended position.

Tool support cross members 36 are mounted at spaced locations to the side members 26 to support a tool such as saw S. Saw S as mounted on tool support cross members 36 of swinging platform portion 24 is shown in FIG. 1 in its lower, stored position, and in FIG. 2 in its upper extended position for use. The swinging platform 24 may be a solid surface for additional work surface for the workbench top 20 if desired. It is noted that the respective lengths of the swinging uprights 22 must be of such length relative to the depth of the workbench top 10 and rectangular swing platform 24 so as to not interfere when platform 24 is in the upper extended position while providing adequate depth for storage of the saw S.

Figure 3:
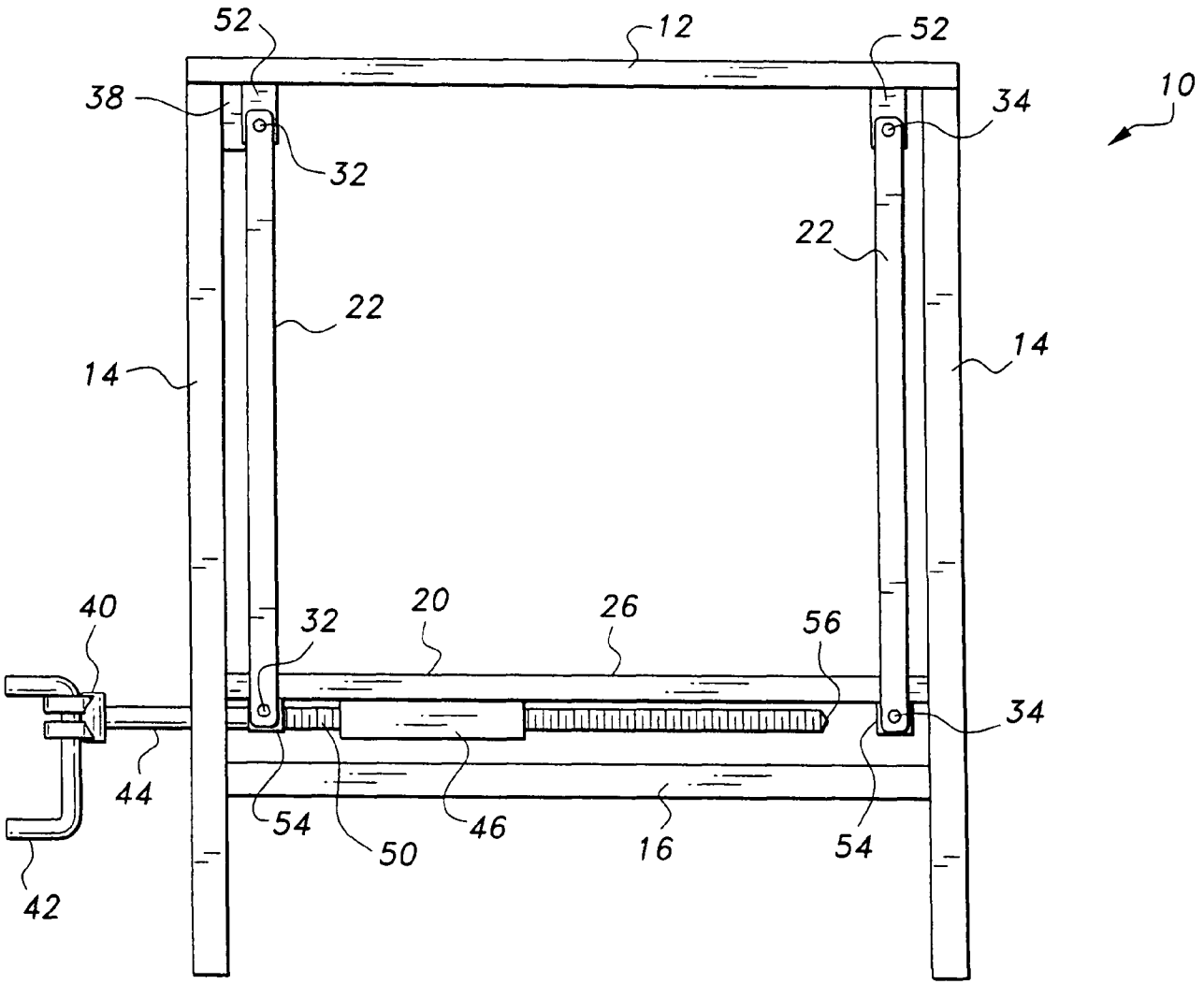
FIG. 3 is a side elevation view of the swinging shelf extension of FIG. 1 in the stored position.
Figure 4:
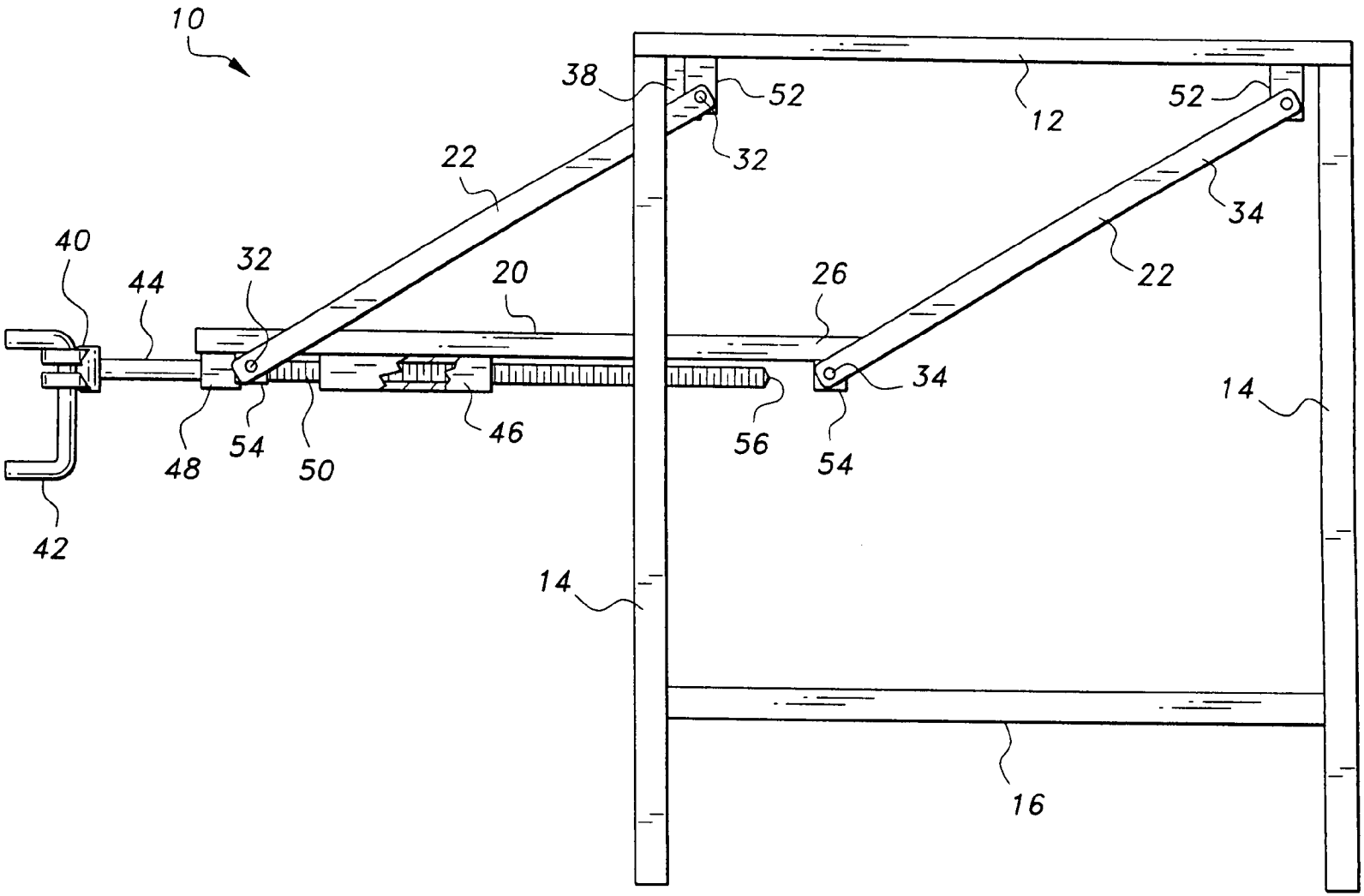
FIG. 4 is a side elevation view of the swinging shelf of FIG. 3 in an intermediate position.

Crankshaft locking block 38 is mounted to the underside of workbench top 12 and receives the tapered end 56 (see FIG. 5) of threaded crankshaft 44 of locking crank operated by crank handle 42. Threaded crankshaft 44 has threads 50 along its length and is mounted in crank screw sleeve 46 having inner threads corresponding to the threads 50 such that crankshaft 44 moves axially inward and outward upon turning locking crank 40 with crank handle 42. Crank screw sleeve 46 is centrally attached under a tool support cross member 36 as by welding. Crankshaft 44 is further supported by front bearing 48 centrally mounted under platform front member 28. A handle 49 is attached to the platform front member 28 for ease in manually raising the swinging shelf extension 20 to the upper extended position and for lowering to the stored position (see FIGS. 1 and 2). As seen in FIGS. 3 and 4, upper axle supports 52 depend from the underside of workbench top 12 and lower axle supports 54 extend upward from the front and rear corners of the swinging platform portion such the swinging uprights 22 are free to swing on front swing axles 32 and rear swing axles 34, respectively. The upper axle supports 52 may be angle supports bolted or welded to the bench top surface 12.

Figure 5:
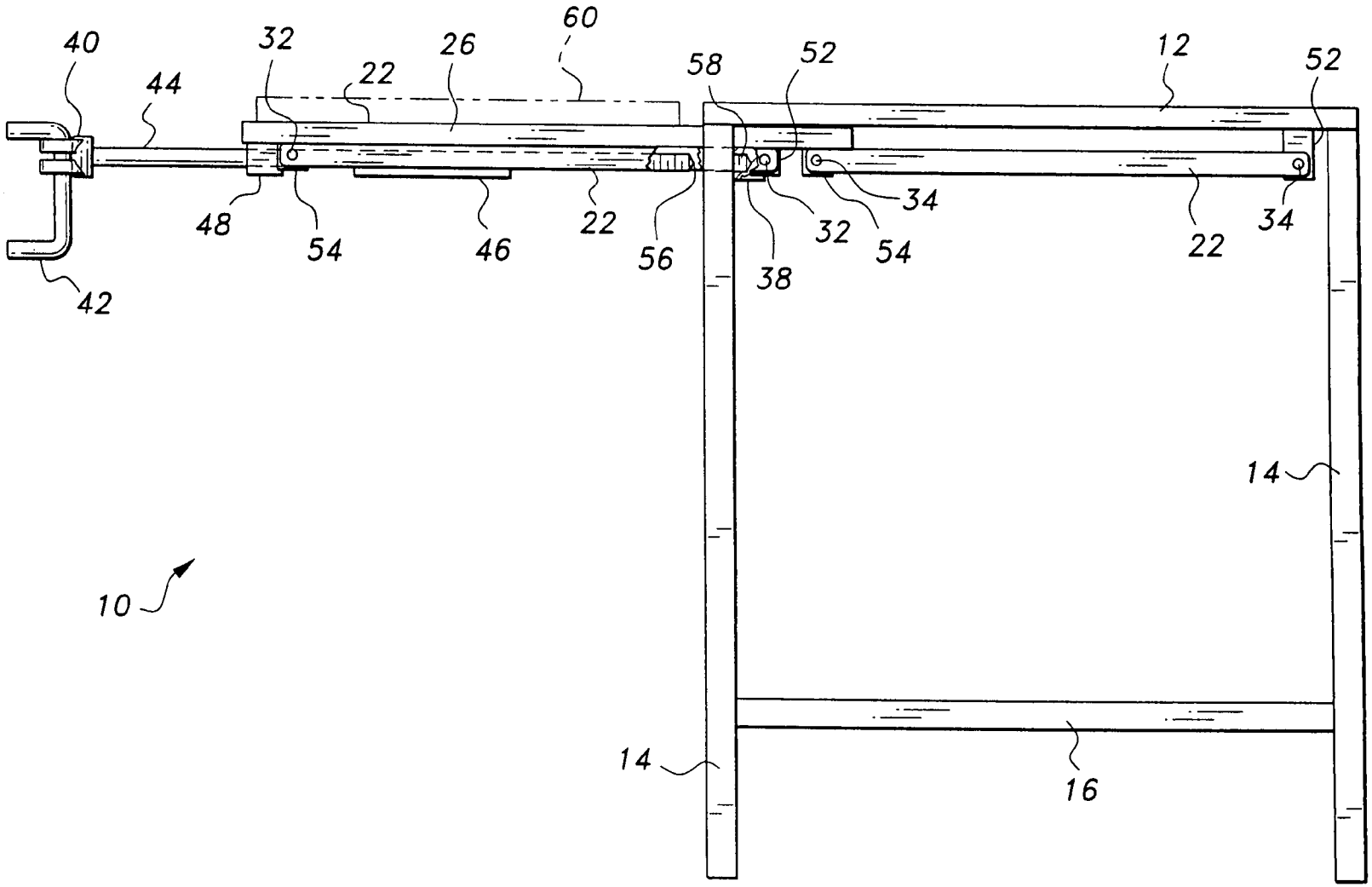
FIG. 5 is a side elevation view, partially broken away, of the swing shelf of FIG. 3 in the upper, extended position.
Figure 6:
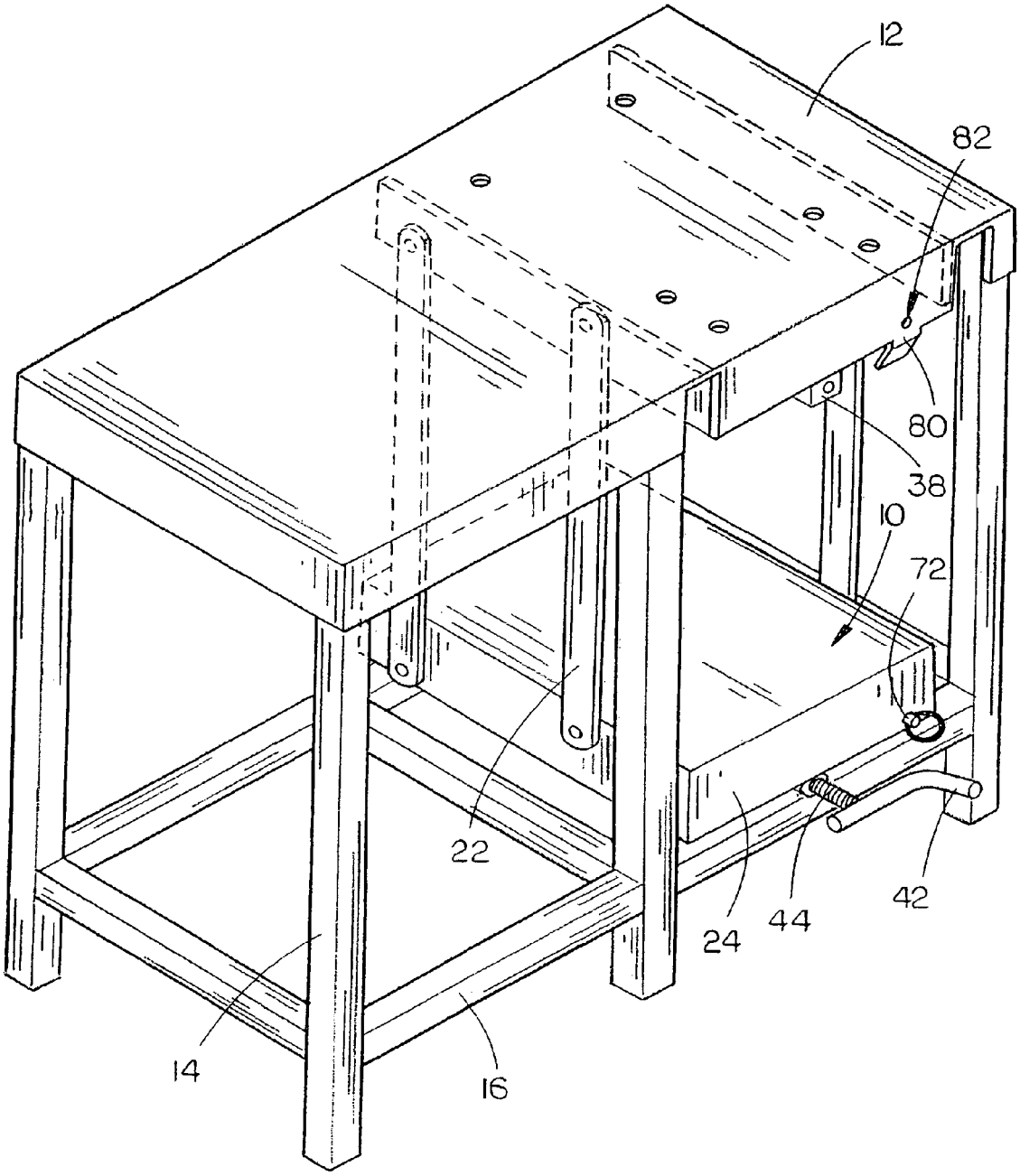
FIG. 6 is a perspective view of an alternative embodiment of the swinging shelf extension of the present invention.
Figure 7:
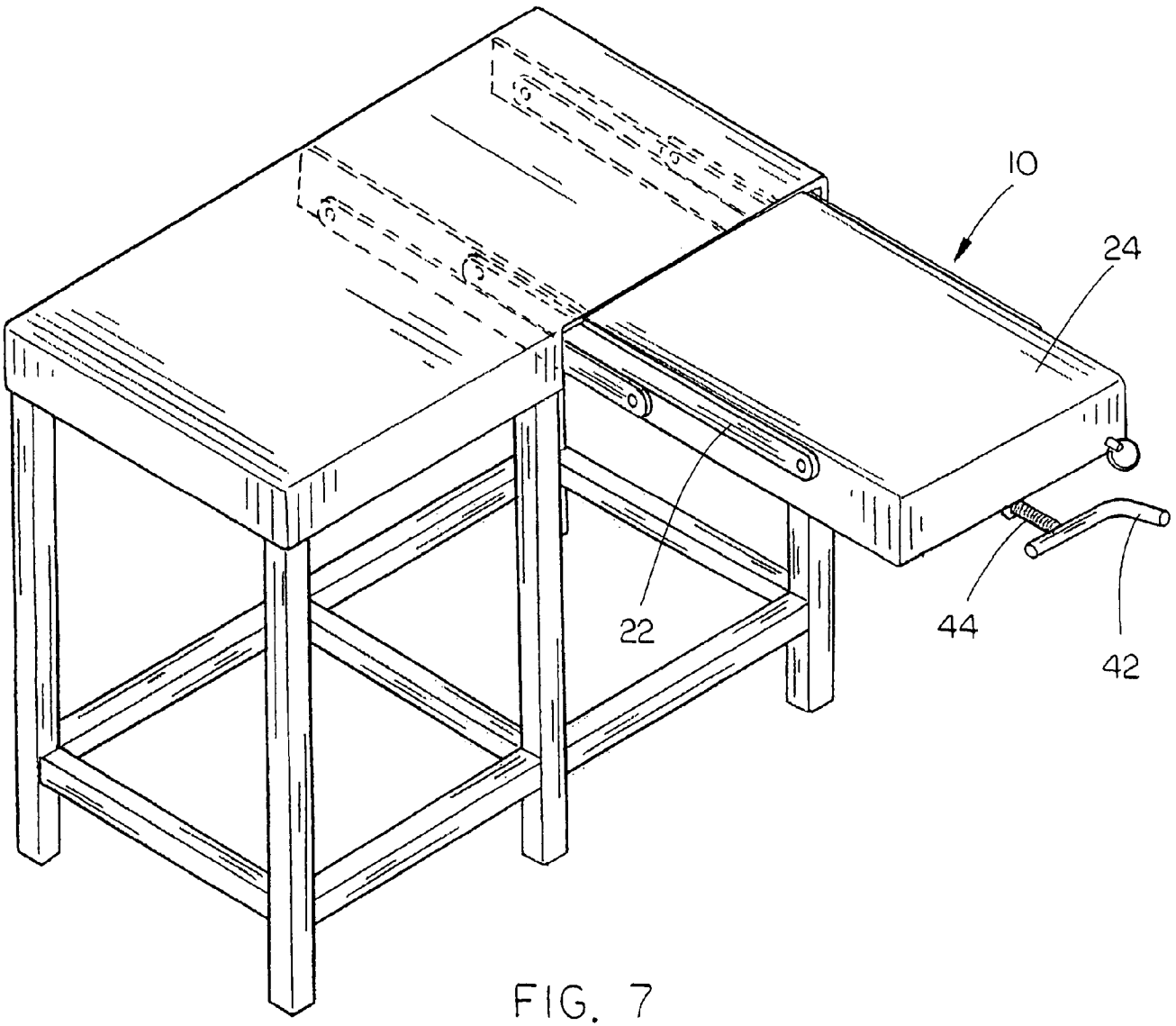
FIG. 7 is a perspective view of the embodiment of FIG. 6 wherein the shelf extension is swung to the upper extended position.
Figure 8:
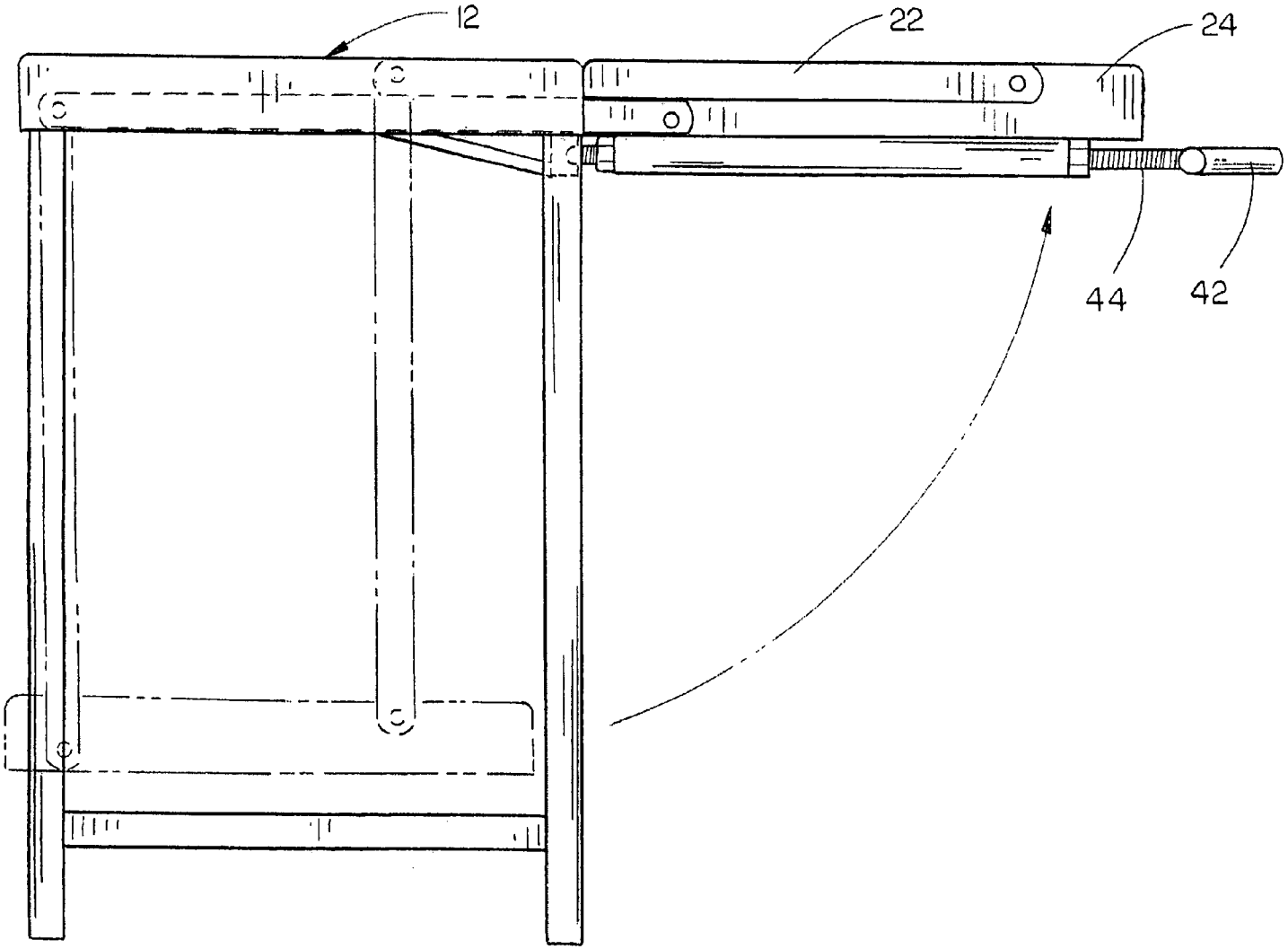
FIG. 8 is a side elevational view of the embodiment of FIG. 6.
Figure 9:
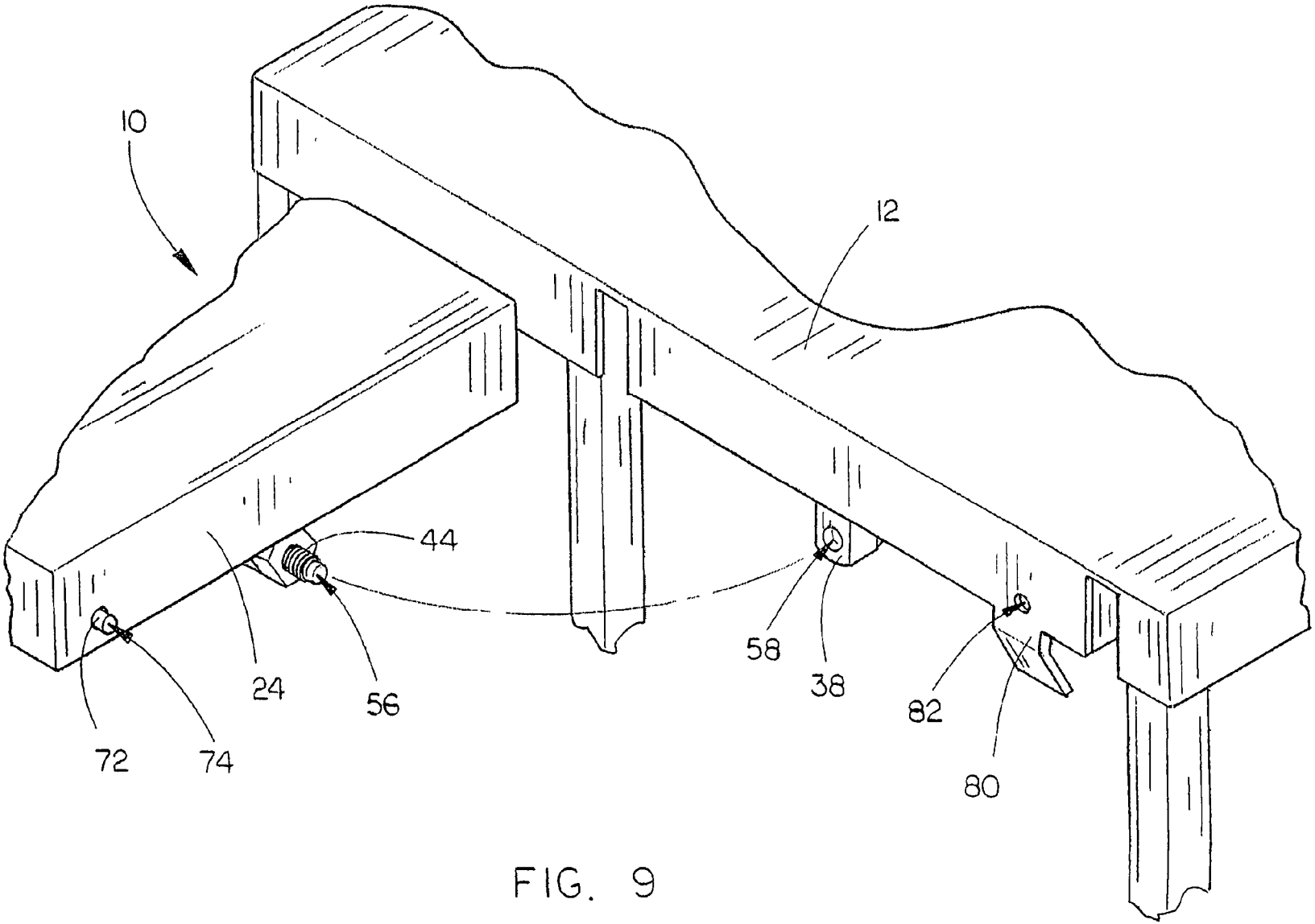
FIG. 9 is a detailed perspective view of the embodiment of FIG. 6 in its disassembled form showing the mechanism by which the shelf extension is secured in the upper extended position when assembled.

Referring to FIG. 5 there is shown a cutaway view showing tapered end 56 of threaded crankshaft 44 aligned for locking into crankshaft locking block 38, and a detail view of the tapered end 56 of crankshaft 44 engaged with crankshaft locking block 38, respectively. The crankshaft locking block 38 has a partial bore 58 therein for positively receiving tapered end 56, thereby locking swinging platform 24 in the upward, extended position for use. FIGS. 4 and 5 also show a workbench extension surface 60 mounted on rectangular swing platform 24 of a thickness and configuration to evenly extend the work surface of top 12.

Although the swinging shelf extension 20 as shown and described is manually lifted and locked, other means may be employed for the lifting, locking, and retracting of the swinging shelf extension 20. Such means may include an electrically driven lift having a screw drive or being gear driven; a hydraulic lift; an air or pneumatic lift; and a spring assist lift employing torsion springs, torsion bars, compression springs or extension springs or a combination thereof. The swing arms may be equipped with a ratcheting mechanism to lock them in the upright, extended position. A one-way shock absorber can be attached for a smooth return of the shelf extension to the down or stored position.

The swing-out shelf extension or appliance shelf can easily be made vertically adjustable as desired to align with the bench top as desired. The swing-out shelf extension may be constructed of steel or other appropriate materials.

Figure 10:
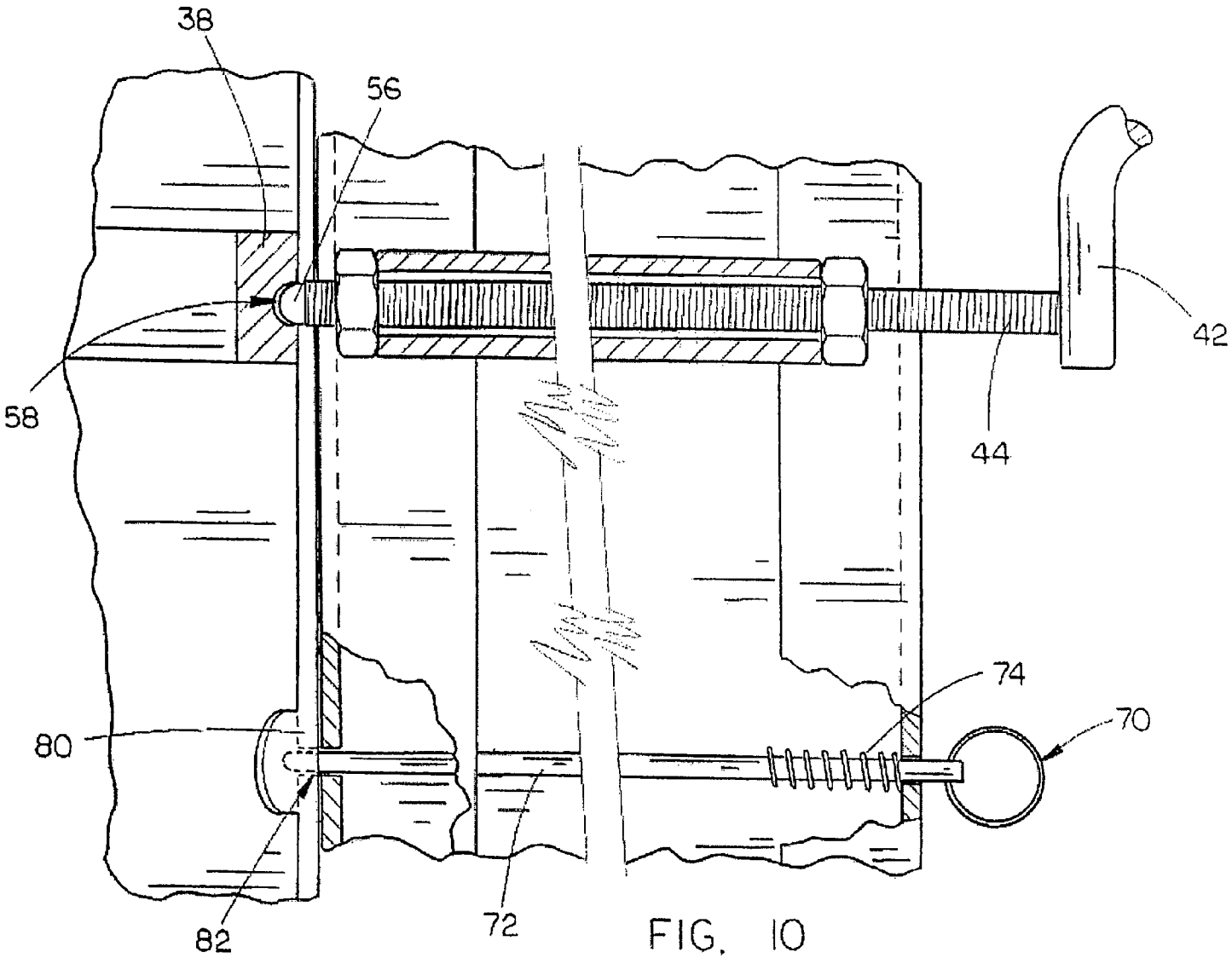
FIG. 10 is a detailed bottom view of the embodiment of FIG. 6 showing the mounting and release devices of the present invention.

FIGS. 6-10 disclose another alternative embodiment of the present invention which is generally similar to that disclosed previously, but includes several additional features which are believed to improve the functionality of the present invention. Specifically, the embodiment includes a longitudinally extended releasable latch pin member 70 which has a pin 72 movably mounted within the swinging platform 24 which extends from the forward wall of the swinging platform 24 to and through the rear wall and further includes a biasing spring 74 as shown in FIG. 10 which forces the pin 72 rearwards. When the swinging platform 24 is in its elevated position, the pin 72 engages plate 80 which includes a latch member receiving structure which in the preferred embodiment would be a pin-receiving hole 82 through which the pin 72 may extend, thus securing the swinging platform 24 in the elevated position without engaging the threaded crankshaft 44, although, of course, this may be engaged as discussed previously to further secure the swinging platform 24 in the elevated position. The swinging platform 24 may then be released from the elevated position by pulling pin 72 forwards to disengage the pin 72 from the pin-receiving hole 82, and now the swinging platform 24 can be returned to its storage position beneath the bench top surface 12.

It is to be understood that the present invention is not limited to the embodiments described above, but encompasses any and all embodiments within the scope of the following claims.

It is to be understood that numerous additions, modifications and substitutions may be made to the swinging shelf extension 20 of the present invention which fall within the intended broad scope of the appended claims. For example, the size, shape and construction materials used in connection with the swinging shelf extension 20 may be modified or changed so long as the intended functional features are neither degraded nor destroyed. Furthermore, although the present invention has been described as being generally designed for use in connection with workbenches and the like, it should be noted that the swinging shelf extension 20 may be used with virtually any type of elevated table-like structure to which the swinging shelf extension 20 may be affixed. Finally, it should be noted that the swinging shelf extension 20 may further include various tool mounting structures on the platform portion 24 in order to more securely mount power tools and the like thereon, and the inclusion of such structures would be understood by one skilled in the art of mounting tools on workbench structures.

There has therefore been shown and described a swing-out workbench system 10 which accomplishes all of its intended objectives.

I claim:

1. A swing-out workbench extension for a workbench having a bench top supported in an elevated position by a workbench frame, said swing-out workbench comprising:

a rectangular swinging platform;

four swinging upright members having equal lengths and upper and lower ends and each pivotably connected at the lower ends thereof to said rectangular platform, two on each side thereof;

said four swinging upright members adapted to be pivotably mounted on the underside of a bench top of a workbench at the upper ends thereof;

said rectangular swinging platform movable between a stored position hanging below a bench top under which said swing-out workbench extension is mounted and an upper extended position generally adjacent a bench top;

said rectangular platform extending generally horizontal in said stored position, said upper extended position, and during said movement between said stored position and said upper extended position; and latch means including a longitudinally extended latch member having a rear engagement portion and latch member receiving means on a workbench, said latch member movably mounted on said rectangular platform and movable between an engagement position wherein said rear engagement portion of said latch member engages said latch member receiving means and releasably locks said rectangular swinging platform in said upper extended position and a disengaged position wherein said rear engagement portion of said latch member does not engage said latch member receiving means.

2. The swing-out workbench extension of claim 1 wherein said latch means comprises a locking block shaft receiver having and defining a forward opening partial bore and attached to and depending from the workbench top and a threaded crankshaft rotatable mounted to the underside of said rectangular swing platform by a crank screw sleeve mounted to one of the said tool support cross members, so as to be centrally located and parallel with said side members, said threaded crankshaft having a forward located crank handle for rotating said crankshaft, and a rear tapered end;

whereby upon swinging said rectangular swing platform to its upper extended position, rotation of said crankshaft by said crank handle in one direction, said crankshaft tapered end engages said forward opening partial bore in said locking block shaft receiver, locking said platform in its upper position, and upon rotation of said crank handle in the other direction, said crankshaft tapered end is withdrawn from said forward opening partial bore, unlocking said platform from its upper position and allowing it to swing to the lower stored position.

3. The swing-out workbench extension of claim 2 wherein said rectangular swing platform includes a workbench extension surface supported thereon for use as a work surface.

4. The swing-out workbench extension of claim 3 wherein said workbench extension surface is extendable to a level generally vertically aligned with the top surface of the workbench top.

5. The swing-out workbench extension of claim 1 wherein said rectangular swing platform includes a workbench extension surface supported thereon for use as a work surface.

6. The swing-out workbench extension of claim 5 wherein said workbench extension surface is extendable to a level generally vertically aligned with the top surface of the workbench top.

7. In combination:

a workbench having a bench top having an underside, said bench top supported in an elevated position by a workbench frame; and a swing-out workbench including;

a rectangular swinging platform;

four swinging upright members having equal lengths and upper and lower ends and each pivotably connected at the lower ends thereof to said rectangular platform, two on each side thereof;

said four swinging upright members adapted to be pivotably mounted on said underside of said bench top of said workbench at the upper ends thereof;

said rectangular swinging platform movable between a stored position hanging below said bench top and an upper extended position generally adjacent said bench top;

said rectangular platform extending generally horizontal in said stored position, said upper extended position, and during said movement between said stored position and said upper extended position; and latch means including a longitudinally extended latch member having a rear engagement portion and latch member receiving means on said workbench, said latch member movably mounted on said rectangular platform and movable between an engagement position wherein said rear engagement portion of said latch member engages said latch member receiving means and releasably locks said rectangular swinging platform in said upper extended position generally adjacent said workbench and a disengaged position.

8. The combination of claim 7 wherein said latch means comprises a locking block shaft receiver having and defining a forward opening partial bore and attached to and depending from the workbench top and a threaded crankshaft rotatably mounted to the underside of said rectangular swing platform by a crank screw sleeve mounted to one of said tool support cross members, so as to be centrally located and parallel with said side members, said threaded crankshaft having a forward located crank handle for rotating said crankshaft, and a rear tapered end;

whereby upon swinging said rectangular swing platform to its upper extended position, rotation of said crankshaft by said crank handle in one direction, said crankshaft tapered end engages said forward opening partial bore in said locking block shaft receiver, locking said platform in its upper position, and upon rotation of said crank handle in the other direction, said crankshaft tapered end is withdrawn from said forward opening partial bore, unlocking said platform from its upper extended position and allowing it to swing to the lower stored position.

9. The combination of claim 8, wherein said rectangular swing platform includes a workbench extension surface supported thereon for use as a work surface.

10. The combination of claim 9 wherein said workbench extension surface extends to a level even with the top surface of said workbench top.

11. The combination of claim 7 wherein said rectangular swing platform includes a workbench extension surface supported thereon for use as a work surface.

12. The combination of claim 11 wherein said workbench extension surface is extended to a level generally vertically aligned with the top surface of said workbench top.

* * * * *